US008028700B2

(12) United States Patent
Hannah et al.

(10) Patent No.: US 8,028,700 B2
(45) **Date of Patent: *Oct. 4, 2011**

(54) FULL FACE FLEXIBLE OXYGEN MASK FOR USE WITH FLIGHT HELMETS

(75) Inventors: Gary R Hannah, Shawnee, KS (US); Kirsten S Frogley, Shawnee, KS (US); Thomas K McDonald, Overland Park, KS (US)

(73) Assignee: Be Intellectual Property, Inc., Wellington, FL (US)

( * ) Notice: Subject to any disclaimer, the term of this patent is extended or adjusted under 35 U.S.C. 154(b) by 785 days.

This patent is subject to a terminal disclaimer.

(21) Appl. No.: 11/847,778

(22) Filed: Aug. 30, 2007

(65) Prior Publication Data

US 2007/0289594 A1 Dec. 20, 2007

Related U.S. Application Data

(63) Continuation of application No. 10/495,009, filed as application No. PCT/US03/30606 on Sep. 24, 2003, now Pat. No. 7,278,421.

(60) Provisional application No. 60/414,901, filed on Sep. 30, 2002.

(51) Int. Cl.
*A62B 18/02* (2006.01)
*A62B 18/08* (2006.01)

(52) U.S. Cl. ..... 128/206.28; 128/200.28; 128/201.22; 128/201.23; 128/202.11; 128/204.18; 128/205.25; 128/206.21; 128/206.24; 128/201.19

(58) Field of Classification Search ..... 128/200.28, 128/201.22, 201.23, 202.11, 204.18, 205.25, 128/206.21, 206.24, 206.28, 201.19
See application file for complete search history.

(56) References Cited

U.S. PATENT DOCUMENTS

| | | | | |
|---|---|---|---|---|
| 2,344,718 | A | 3/1944 | Morehouse | |
| 2,379,493 | A | 7/1945 | Morehouse | |
| 2,810,022 | A | 10/1957 | Finken et al. | |
| 2,908,272 | A | 10/1959 | Motsinger | |
| 2,918,060 | A | 12/1959 | Lobelle | |
| 3,362,403 | A * | 1/1968 | Fleming et al. | 128/201.24 |
| 3,513,841 | A | 5/1970 | Seeler | |
| 3,833,935 | A | 9/1974 | Ansite et al. | |
| 3,910,269 | A | 10/1975 | Ansite et al. | |
| 4,069,516 | A | 1/1978 | Watkins, Jr. | |
| 4,315,335 | A * | 2/1982 | Kennedy et al. | 2/424 |
| 4,352,353 | A | 10/1982 | Bolton et al. | |

(Continued)

FOREIGN PATENT DOCUMENTS

EP 705622 A1 * 4/1996

(Continued)

*Primary Examiner* — Justine Yu
*Assistant Examiner* — Clinton Ostrup
(74) *Attorney, Agent, or Firm* — Fulwider Patton LLP

(57) ABSTRACT

The full face flexible oxygen mask for use with flight helmets includes an elastic face seal with an oronasal cone that seals around the nose and mouth of the wearer, and flexible sealing flaps along the perimeter of the face seal to adapt the face piece of the mask to seal against the surface of a flight helmet. The mask face piece has two large sealing surfaces or channels down each side of the mask that overlap and flex to adapt to seal to a variety of flight helmets. The top of the face seal has an inner and outer flap that work together to seal the exposed face visible between the sides of the flight helmet.

7 Claims, 2 Drawing Sheets

U.S. PATENT DOCUMENTS

| | | | | | |
|---|---|---|---|---|---|
| 4,595,003 | A | | 6/1986 | Shoemaker et al. | |
| 4,713,844 | A | * | 12/1987 | Westgate | 2/411 |
| D304,384 | S | | 10/1989 | Derobert | |
| 4,875,477 | A | | 10/1989 | Waschke et al. | |
| 4,905,683 | A | * | 3/1990 | Cronjaeger | 128/202.22 |
| 5,039,035 | A | | 8/1991 | Fitzpatrick | |
| 5,488,948 | A | | 2/1996 | Dubruille et al. | |
| 5,555,569 | A | | 9/1996 | Lane | |
| 5,575,278 | A | | 11/1996 | Bonhomme et al. | |
| D378,610 | S | | 3/1997 | Reischel et al. | |
| 5,630,412 | A | | 5/1997 | Dubruille et al. | |
| 5,653,225 | A | | 8/1997 | Schegerin | |
| 5,664,566 | A | | 9/1997 | McDonald et al. | |
| 5,704,073 | A | | 1/1998 | Sword et al. | |
| 5,924,420 | A | * | 7/1999 | Reischel et al. | 128/206.21 |
| 5,941,245 | A | * | 8/1999 | Hannah et al. | 128/207.11 |
| 6,155,253 | A | | 12/2000 | Gamberini | |
| 6,161,538 | A | * | 12/2000 | Bonhomme et al. | 128/204.21 |
| 6,401,716 | B1 | | 6/2002 | Sword et al. | |
| 6,520,177 | B1 | * | 2/2003 | Bonhomme et al. | 128/201.28 |
| 6,567,220 | B2 | | 5/2003 | McDonald et al. | |
| 6,578,572 | B2 | | 6/2003 | Tischer et al. | |
| 7,210,477 | B2 | | 5/2007 | Templeton et al. | |
| 7,278,421 | B2 | * | 10/2007 | Hannah et al. | 128/201.29 |
| 2002/0134381 | A1 | | 9/2002 | Bonhomme et al. | |
| 2005/0103335 | A1 | | 5/2005 | Fabin | |

FOREIGN PATENT DOCUMENTS

| | | | |
|---|---|---|---|
| EP | 885632 | A1 * | 12/1998 |
| GB | 1191793 | | 5/1970 |

* cited by examiner

FIG. 1
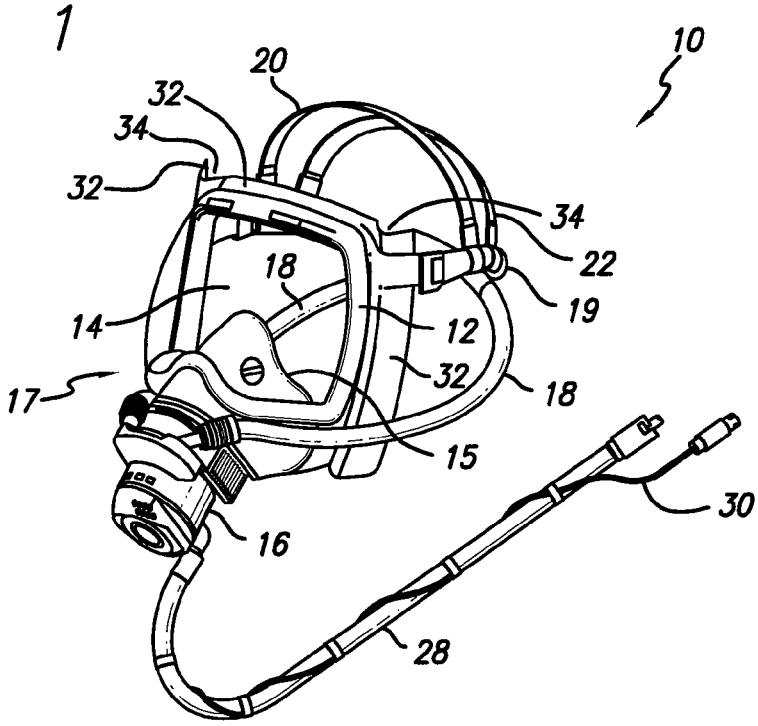
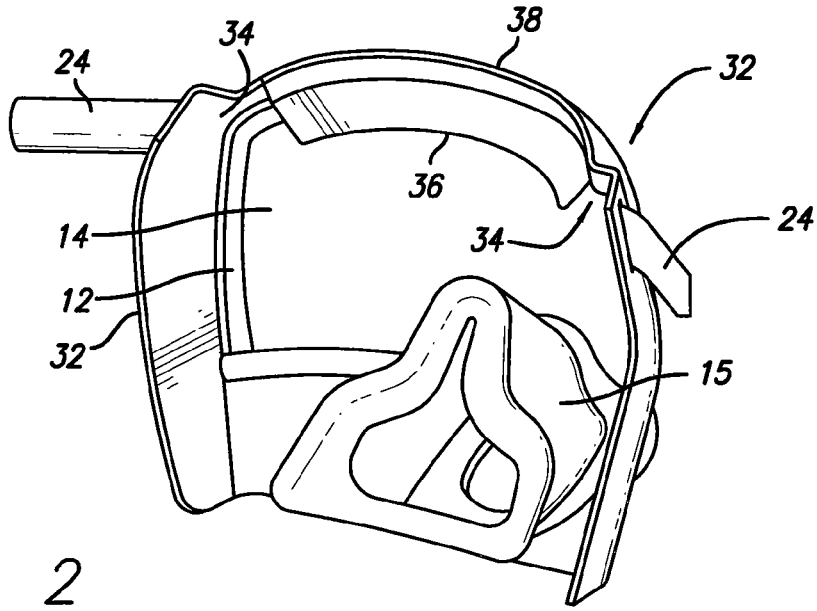
FIG. 2

FIG. 3
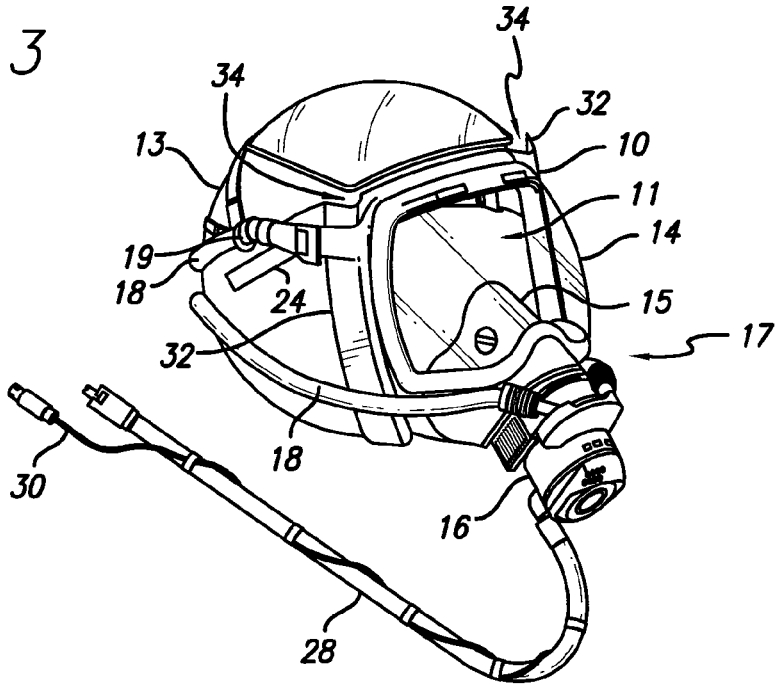
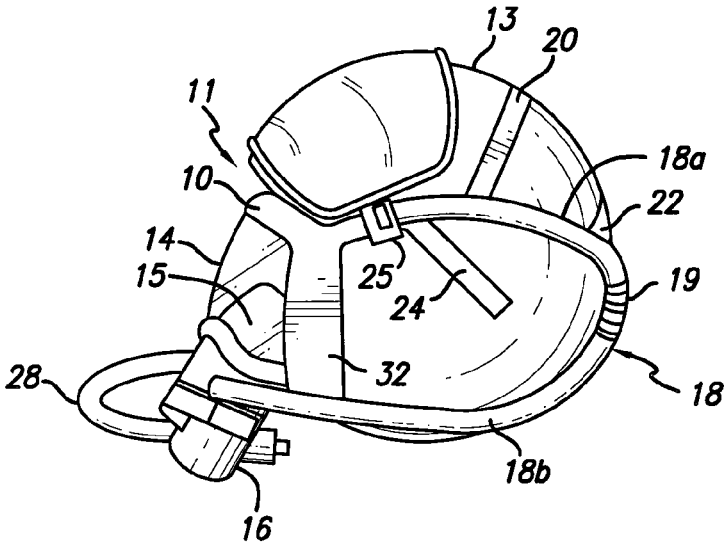
FIG. 4

FULL FACE FLEXIBLE OXYGEN MASK FOR USE WITH FLIGHT HELMETS

CROSS-REFERENCE TO RELATED APPLICATIONS

This is a continuation of application Ser. No. 10/495,009, filed 10 May 2004, now U.S. Pat. No. 7,278,421, which is a U.S. National Phase of PCT/US03/30606, filed 24 Sep. 2003, which is based on Provisional Application No. 60/414,901, filed 30 Sep. 2002.

BACKGROUND OF THE INVENTION

The present invention relates to oxygen masks, and more particularly relates to oxygen masks used with military aircraft pilot helmets.

Currently standard flight helmets for fixed wing and rotor aircraft use the same clip on oxygen mask as found on fighter helmet applications. This provides oxygen/hypoxia protection but no "smoke" protection. Smoke protection is usually considered to include some form of sealed eye protection with an integral positive pressure or other means for keeping contaminants out, in addition to respiratory protection. Flight helmets come in a variety of sizes and designs, thus making the application of a single mask to a variety of designs a difficult problem. This represents a significant disadvantage in light of the large number of different flight helmet designs that currently exist.

For example, one such conventional smoke mask that currently will fit within and interact with a flight helmet has a design that requires that the flight helmet and front opening of the flight helmet be large enough to allow the face seal of the smoke mask to fit inside the flight helmet for direct contact with the wearer's face. This design is constrained to fit completely within the flight helmet to contact the face, limiting the field of view available to the wearer.

Current full face oxygen masks are also typically designed to fit on the heads and facial features of about 5 to 95 percent of pilots and crew, but these masks typically will not fit or interact with a pilot or crew member additionally wearing a flight helmet for protection.

Thus, there is a need for an oxygen mask which provides an adequate breathing gas environment and protection from smoke and debris which can be adapted for use with a wide variety of pilot helmets. The present invention fills these and other needs.

SUMMARY OF THE INVENTION

Briefly, and in general terms, the present invention provides for a full face flexible oxygen mask for use with flight helmets, wherein the mask includes an elastic face seal that has an oronasal cone that seals around the nose and mouth to provide the maximum required contaminant and leakage protection, and flexible sealing flaps along the perimeter of the face seal to seal against the surface of a flight helmet, rather than sealing to the face of the wearer. The mask face piece has two large sealing surfaces or channels down each side of the mask that overlap and flex as necessary to adapt to seal to a variety of flight helmet designs and exterior surfaces currently being used. The top of the face seal has inner and outer sealing flaps that work together to seal the exposed face of the wearer visible between the sides of the flight helmet. In one variant, the sealing flaps may have a chamber inside that may be at least partially inflated to enhance the sealing properties of the sealing flaps. By eliminating the constraint of fitting completely within the flight helmet perimeter to contact the face of the wearer, and providing flexible sealing flaps to adapt to seal with a variety of sizes and types of flight helmets, allowing the use of larger size flight helmets, the full face flexible oxygen mask of the invention avoids limitations upon the field of view available to the wearer that are characteristic of face masks that are constrained to fit completely within the flight helmet perimeter to insure sealing contact with the face of the wearer.

These and other aspects and advantages of the invention will become apparent from the following detailed description and the accompanying drawings, which illustrate by way of example the features of the invention.

BRIEF DESCRIPTION OF THE DRAWINGS

FIG. 1 is a front perspective view of the full face flexible oxygen mask according to the invention.

FIG. 2 is an interior view of a front portion of the full face flexible oxygen mask of FIG. 1.

FIG. 3 is a front perspective view of the full face flexible oxygen mask of FIG. 1 fitted to a flight helmet.

FIG. 4 is a side view of the full face flexible oxygen mask of FIG. 1 placed fitted to a flight helmet.

DETAILED DESCRIPTION OF THE PREFERRED EMBODIMENTS

As is illustrated in the drawings, the invention is embodied in a full face flexible oxygen mask for use as a smoke mask with flight helmets, that can adapt to fit to most or all flight helmets and provide smoke/eye protection along with oxygen. The full face flexible oxygen mask is embodied in a flexible, full face coverage mask for use by aircraft flight crews in which a flexible lens is sealingly molded into the face seal, or is formed with the face seal as a single unit. The mask incorporates an inflatable harness which is inflated by the breathing oxygen regulated by a regulator incorporated into the face mask. In one aspect of the full face flexible oxygen mask, the inflatable harness is dimensioned so as to fit over the circumference of the helmet. The mask also provides for purging of the interior of the flexible lens by gas from the regulator in order to retard fogging and other obscuration of the view out of the lens by the wearer. The entire assembly is capable of being rolled up into a relatively small package, which facilitates its installation within the limited available space readily at hand to the seated crew member on the flight deck. An interactive full face mask according to the invention, stowed in a ready position for quick donning, could readily be mounted on Air Force, Naval, Army, Coast Guard type support craft such as the E-2C, C-2, P-3, and C130, for example.

Referring to FIGS. 1 and 2, the full face flexible oxygen mask 10 for use as a smoke mask with a flight helmet includes an elastic, flexible face seal or face piece 12, having a flexible lens 14 in the face seal. Referring to FIGS. 3 and 4, the full face flexible oxygen mask is formed to fit over the front opening 11 of a helmet 13. The lens of the face seal is typically made of a flexible elastomer and helps the face seal adapt to the various helmet and facial surfaces it will encounter rather than restrict it like a hard lens design would. At the same time, the flexible lens material has a high level of optical quality suitable for flying an aircraft. The elastic face seal includes an oronasal cone 15 that seals around the nose and mouth of the wearer to provide the maximum required contaminant and leakage protection.

The lower forward portion of the face seal includes an oxygen supply regulator 16 removably attached to the lower forward portion 17 of the mask to provide oxygen in diluted, 100%, positively pressurized forms to the user. The regulator supplies breathing oxygen to the wearer through ports internal to the lower forward portion of the face seal, and also supplies oxygen or other breathing gas mixtures to an inflatable harness 18 such as inflatable tubes 18*a* and 18*b*, designed to encircle the helmet, and connected to the breathing gas regulator and the face seal via suitable gas passages and connectors in the mask. As is illustrated in FIG. 4, the inflatable tubes 18*a* and 18*b* are typically joined by a connector 19. Purge valves are integral to the mask and provide a positive oxygen flow to purge any contaminants that might leak into the mask visor area, to augment the seal performance. The inflatable harness is connected to the face seal and regulator that will allow the mask to be quickly donned and positioned over a helmet. The harness, when inflated, will pull the face seal firmly against the helmet and face. Connecting straps 20 and 22 are then similarly connected at their extremities to the inflatable harness, and may also be adjustable to allow for adjustment of the size and comfort of the mask once the inflatable harness is inflated. Additional straps 24 connected to the face seal may be provided to connect the face seal to the inflatable harness, such as by an adjustable buckle 25, for example.

The use of the flexible lens in concert with the elastomeric face seal of the invention serves to improve the ability of the mask to seal out toxic or vision impairing gases. These improved face sealing characteristics also improve the oxygen consumption performance of the mask, as there is less leakage over a wider variety of face configurations. The oxygen supply for the mask is provided by an oxygen supply tube 28 connected to regulator. In order to facilitate communication, the mask may also incorporate a microphone (not shown) which can be connected to the aircraft communication system by electrical wiring 30, which may be concurrently routed with the oxygen supply tube.

Referring to FIGS. 1 and 2, flexible sealing flaps 32 are provided at selected points along the perimeter of the face seal to adapt the face seal of the mask to seal against the helmet rather than sealing to the face of the wearer. Typically the flexible sealing flaps are provided along the top, left and right sides of the face seal. The mask face piece also has two large sealing surfaces or channels 34 along each side of the mask that overlap and flex as necessary to adapt to a variety of helmet designs and exterior surfaces currently being used. As is illustrated in FIG. 2, the top sealing flap 32 of the face seal includes an inner flap 36, adapted to form a seal along the forehead of the wearer, and an outer flap 38 for sealing along the helmet, that work together to seal the exposed face visible between the sides of the helmet. In one variant, the inner and/or outer flaps of the top flexible sealing flap, as well as the left and right side flexible sealing flaps, may include one or more internal chambers that may be connected to the oxygen supply regulator so as to be at least partially inflatable to enhance the sealing properties of the sealing flaps.

The mask fits to a variety of helmet designs with slightly different dimensions and fits on the user's head. The flexibility of the frame and lens allow the mask to adapt or conform the helmet surfaces until the oronasal cone and face seal contact the recessed user's facial features. It will be appreciated that by eliminating the constraint of fitting completely within the helmet to contact the face of the wearer, the full face flexible oxygen mask of the invention avoids the limitations of field of view that are characteristic of face masks that are constrained to fit completely within the flight helmet perimeter to insure sealing contact with the face of the wearer.

It will be apparent from the foregoing that while particular forms of the invention have been illustrated and described, various modifications can be made without departing from the spirit and scope of the invention. Accordingly, it is not intended that the invention be limited, except as by the appended claims.

The invention claimed is:

1. In a quick-donning full face oxygen mask for use as a smoke mask with a flight helmet having an exterior surface and a forwardly facing front opening in oxygen depleted environments and environments contaminated by smoke or other pollutants, the improvement comprising:

a flexible helmet seal, said flexible helmet seal including first and second sides, a top side and a bottom side, an interior, and a pliable, flexible periphery, said flexible helmet seal including a flexible optical lens in a region adapted to overlie a wearer's eyes, and the flexible helmet seal including first and second rearwardly facing side channels defined by sealing surfaces along each of said first and second sides of the mask, respectively, that overlap and fit over the forwardly facing front opening of the flight helmet and flex to adapt to seal to the exterior surface of the flight helmet;

said flexible helmet seal including a plurality of flexible sealing flaps at selected points, including first and second side flexible sealing flaps along the first and second sides of the helmet seal and an outer top flap on the top side of the flexible helmet seal, said first and second side flexible sealing flaps and said outer top flap being configured to seal to the exterior surface of the flight helmet; and said outer top flap extending between said first and second side flexible sealing flaps and said first and second rearwardly facing side channels.

2. The quick-donning full face oxygen mask of claim 1, further comprising an inner top flap, said inner and outer top flaps cooperating to seal the wearer's face between the first and second sides of the flight helmet.

3. The quick-donning full face oxygen mask of claim 1, further comprising an oronasal cone along the bottom side of the helmet seal that seals around the wearer's nose and mouth.

4. The quick-donning full face oxygen mask of claim 1, further comprising an oxygen supply regulator removably attached to said flexible helmet seal.

5. The quick-donning full face oxygen mask of claim 4, further comprising an inflatable harness attached to said flexible helmet seal adapted to fit over the flight helmet, said inflatable harness including at least one tube connected to said oxygen supply regulator and supplied oxygen by said oxygen regulator for inflation of said inflatable harness.

6. The mask of claim 5, wherein said inflatable harness further comprises adjustable straps connected to said flexible helmet seal at positions which allow the adjustment of the inflatable harness for size and comfort by a wearer.

7. The mask of claim 6, wherein said inflatable harness further comprises a plurality of inflatable harness tubes connected to said oxygen supply regulator and adjustably connected to said flexible helmet seal by said adjustable straps.

* * * * *